United States Patent [19]

Colin

[11] 4,173,938

[45] Nov. 13, 1979

[54] ANCHORS AND ANCHORING SYSTEM

[75] Inventor: Armand T. Colin, Versailles, France

[73] Assignee: Constructions Metalliques de Provence, France

[21] Appl. No.: 837,407

[22] Filed: Sep. 28, 1977

[30] Foreign Application Priority Data

Oct. 6, 1976 [FR] France ..... 76 30135

[51] Int. Cl.[2] ..... B63B 21/34

[52] U.S. Cl. ..... 114/301; 114/294

[58] Field of Search ..... 114/293, 294, 297–310

[56] References Cited

U.S. PATENT DOCUMENTS

| | | | |
|---|---|---|---|
| 1,858,347 | 5/1932 | Swift | 114/300 |
| 3,716,012 | 2/1973 | Wright | 114/304 |
| 3,776,172 | 12/1973 | Lambert | 114/301 |
| 3,822,664 | 7/1974 | Hedman | 114/307 |

FOREIGN PATENT DOCUMENTS

| | | | |
|---|---|---|---|
| 2352144 | 4/1975 | Fed. Rep. of Germany | 114/304 |

*Primary Examiner*—Trygve M. Blix
*Assistant Examiner*—D. W. Keen
*Attorney, Agent, or Firm*—Wenderoth, Lind & Ponack

[57] ABSTRACT

The anchoring system comprises a combination of two types of anchors. One anchor comprises an anchoring element of the plough type and a shank. The plough has the shape of a dihedral having lateral edges contained in a common plane perpendicular to the bisecting plane of the dihedral. The corner edge of the dihedral is inclined toward the common plane from one end of the corner edge in the vicinity of which end the shank is fixed to the plough. The other anchor comprises an anchoring element of the "sheet" type and a coupling device for coupling the element to pulling apparatus. The element has a part-cylindrical surface whose concavity faces the coupling device and is curved in the direction of the span of the surface so that any tangent to the part-cylindrical surface in a plane perpendicular to the axis of the part-cylindrical surface is orthogonal to the direction of the pull exerted on the anchor in service.

21 Claims, 10 Drawing Figures

ANCHORS AND ANCHORING SYSTEM

The present invention relates to anchors and anchoring systems employed for positioning on water floating machines such as for example drilling platforms, drags, landing stages, river crossing installations for rivers having a rapid current, etc.

With the development of the technique, these machines tend to have ever increasing dimensions while requiring to be positioned with high precision and safety. Moreover, bearing in mind that they are often subjected to very high dynamic forces by the action of the wind and waves, more and more powerful anchoring systems have been found necessary.

In the anchor art, one of the solutions for increasing the anchoring power consists in employing anchors of increased dimensions and weight. However, this is unsatisfactory since, for a given anchor design, the ratio between the anchoring power and the weight of the anchor very rapidly decreases with increase in weight, that is to say, increasing the weight of the anchor, which constitutes a disadvantage from the point of view of handling, transport and storing, does not result in a corresponding increase in the anchoring power. In an attempt to solve this problem of increasing the anchoring power, there are also known techniques termed mooring across and backing, the first consisting in dropping a plurality of anchors, usually two anchors, on divergent mooring lines whereas the second consists in connecting two or more anchors in end-to-end relation at the end of the mooring line by means of connecting chains or cables. These two arrangements are not satisfactory either, since they increase the dead weight without guaranteeing the good simultaneous operation of the anchors or increasing their unit stability.

An object of the invention is to avoid these many drawbacks of the prior art and to provide an anchoring system which has optimum efficiency in all the possible varieties of grounds as concerns both on surface and in depth.

According to the invention, there is provided a modular anchoring system comprising at least a first anchor having an anchoring element of the plough type adapted to be connected to pulling means and at least a second anchor of the "sheet" type which is placed in front of the first anchor, said first and second anchors being pivotally interconnected by a transverse pivot pin adapted to impart to said system a transverse rigidity and permit a relative pivoting between said anchors in the longitudinal plane, in which plane the pull is exerted on the system in service of the anchoring system.

The invention also provides an anchor for grounds which are soft to very hard, of the type comprising a plough and a shank and adapted in particular to be employed in the aforementioned anchoring system, wherein the plough has a dihedral shape the lateral sides of which have longitudinal edges which are disposed in a common plane perpendicular to the bisecting plane of the dihedral angle, the edge of the dihedron being inclined with respect to said common plane from one of the ends thereof in the vicinity of which end the shank is secured to the plough.

According to the invention, there is also provided an anchor for grounds which are soft to very soft adapted in particular to be employed in the aforementioned anchoring system, said anchor comprising an anchoring element of the "sheet" type, and a coupling device for connecting said element to pulling means, the anchoring element having a part-cylindrical surface the concavity of which surface faces the coupling device, wherein the anchoring element is curved in the direction of the span thereof so that any tangent to said part-cylindrical surface in a cross section is orthogonal to the direction of pull exerted on said anchor.

Further features and advantages of the invention will be apparent from the ensuing description with reference to the accompanying drawings which are given merely by way of example and in which.

Figure 1:
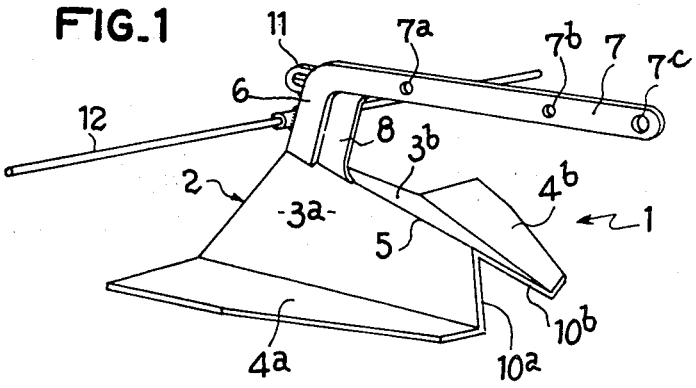
FIG. 1 is a perspective view of an anchor according to the invention having an anchoring element of the plough type.
Figure 2:
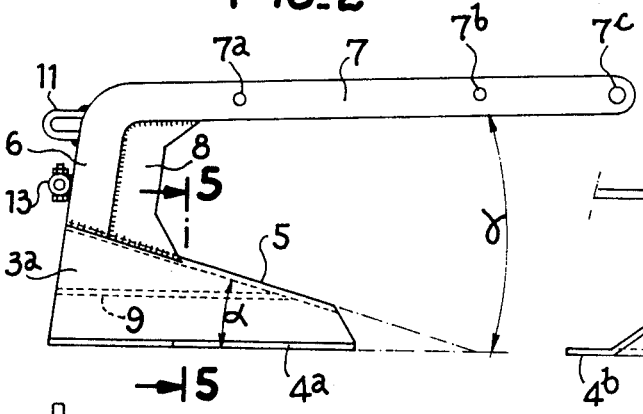
FIG. 2 is a side elevational view of the anchor shown in FIG. 1.
Figure 4:
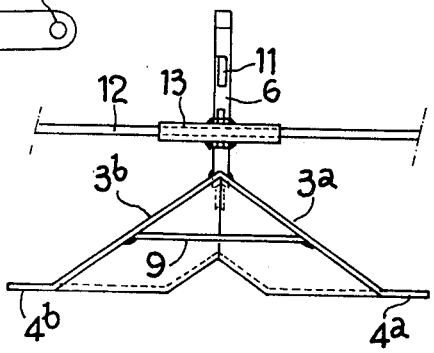
FIG. 4 is a front end elevational view of the anchor shown in FIG. 1.
Figure 3:
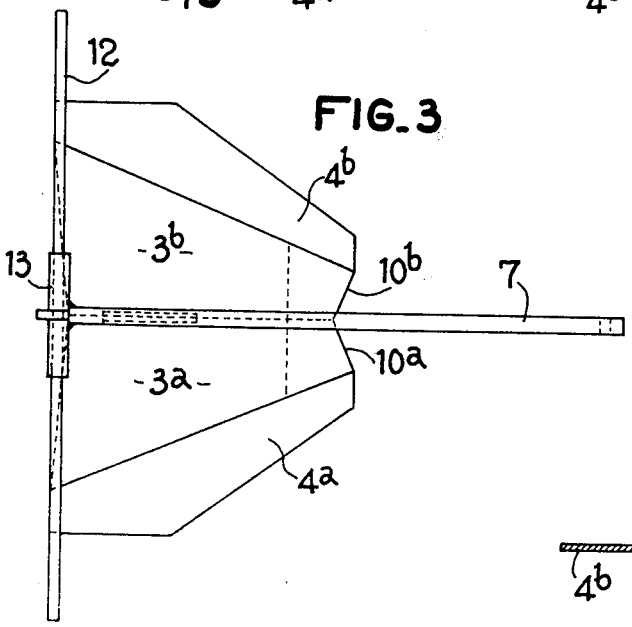
FIG. 3 is a top plan view of the anchor shown in FIG. 1.
Figure 5:
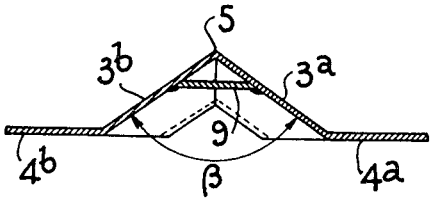
FIG. 5 is a sectional view taken on line 5—5 of FIG. 2.

With reference first to FIGS. 1 to 5, the illustrated anchor 1 comprises a plough 2 having the shape of a dihedron the lateral sides $3^a$, $3^b$ of which are extended outwardly by wings $4^a$, $4^b$ which are contained in a common plane perpendicular to the bisecting plane of the dihedron, the edge 5 of the latter being inclined relative to said common plane at an angle $\alpha$ between preferably about 10° and about 45° from one of the ends thereof in vicinity of which end a crook or cranked portion 6 extended by a shank 7 is fixed to the plough 1. This shank is provided with apertures $7^a$, $7^b$, $7^c$ to permit a coupling (side-by-side disposition or a backing (end-to-end disposition) with other anchors as will be explained hereinafter. Preferably, the lateral sides $3^a$, $3^b$ make therebetween an angle $\beta$ between about 90° and about 130°, for example 110°, and the shank 7 is inclined with respect to said common plane at an angle of $\gamma$, preferably equal to about 5°, to provide the highest anchoring force in compact, semi-soft and soft grounds. It will be understood that the angles $\alpha$, $\beta$, $\gamma$ may be modified to adapt the characteristics in accordance with the parameters of use and with the rigidity of the anchor, which depends on the material employed.

Preferably, the lateral sides $3^a$, $3^b$ and the wings $4^a$, $4^4$ of the plough 1 are constituted by two metal sheets which are folded and welded along the edge 5. Further, the connection between the shank 7 and the plough 1 is reinforced by a plate 8 which is disposed inside the angle made by the crook 6 and welded to the shank 7 and to the plough 1. The rigidity of the plough 1 is itself reinforced by a stiffening plate 9 which extends in a direction parallel to the common plane of the wings $4^a$, $4^b$ between the lateral sides $3^a$, $3^b$ of the dihedron. This plate 9 may have at the rear a notch to facilitate the fitting together of a plurality of anchors. Preferably, the plough 1 has a truncated end defining two inclined faces $10^a$, $10^b$ for penetration in the ground, these faces being inclined with respect to the common plane in the same direction as the edge 5. These inclined faces reduce the amidship size (which creates an obstacle to the penetration of the plough 1 in the ground) and impart to the plough a very rapid engagement. However, by way of a modification, the plough 1 may have a closed point as shown in dot-dash line in FIG. 2.

Welded to the front part of the crook 6 is a hooking member 11 which extends in the opposite direction to the shank 7 and is adapted to permit the backing or end-to-end hooking of the anchor 1 to another anchor. Alternatively, the hooking member may be replaced by an aperture provided in the crook or the shank if the latter are strong enough. The anchor 1 is completed by a detachable stock constituted by a bar 12 received in a section of a tube 13 (welded to the front part of the crook 6) and fixed in the tube section by detachable fixing means, such as, for example, a bolt and nut. The presence of the stock 12 is desirable when the anchor 1 is employed alone or backed with one or more other identical anchors to increase the lateral stability thereof. On the other hand, the stock may be eliminated when the anchor 1 is rigidly coupled with other identical anchors or backed with an anchor of another type having a high transverse stability, as will be described hereinafter.

As concerns the use of the anchor, it will be noted that the anchor 1 described hereinbefore is a positioning anchor for floating working machines and must be disposed flat on the bottom by an auxiliary vessel, and not a casting anchor employed by a vessel for mooring. This anchor provides a very high safety in operation since, owing to the inclined faces thereof forming sharp lips, it penetrates the ground on the spot without sliding when it is subjected to a pull. The inclined faces and the planar shapes thereof moreover enable it to easily penetrate all grounds which are soft to very hard for which it is particularly well adapted. Moreover, for a given weight, it has an anchoring power which is substantially higher than the conventional casting anchors of the plough or ploughshare type, since it is made from relatively thin planar elements which impart thereto a total area which is much larger than that of these conventional anchors which are made from a cast metal. Compared with the conventional anchors, the anchor 1 according to the invention has the further advantage of being of a much simpler and cheaper construction owing to the fact that it is made from planar plates which may be of a conventional material of light alloy or even cement and are assembled, and possibly bent, by techniques which are particularly easy to carry out, such as welding, girder construction etc. There will also be noted the interest of the shapes with a self-operative angular shaped section of the dihedron which permits, for a relatively small weight, withstanding high bending moments produced on the anchoring surfaces without thickening the latter.

Note that many modifications may be made in the embodiment described hereinbefore without departing from the scope of the invention. Thus, for example, the plough 1 could be without wings or the latter may be detachable, the presence of the wings is justified up to certain dimensional ratios since they increase the anchoring power of the anchor without affecting the dynamic stability thereof. This dynamic stability may be increased by providing at appropriate points of the anchor deflector flaps adapted to improve the lateral stability thereof. Moreover, the shank 7 may have a chamfered, rectangular, oval, or round section, or it may be constituted by two substantially parallel round or square bars. Further, this shank may be solid or hollow.

Figures 6, 7, 8, 9, 10:
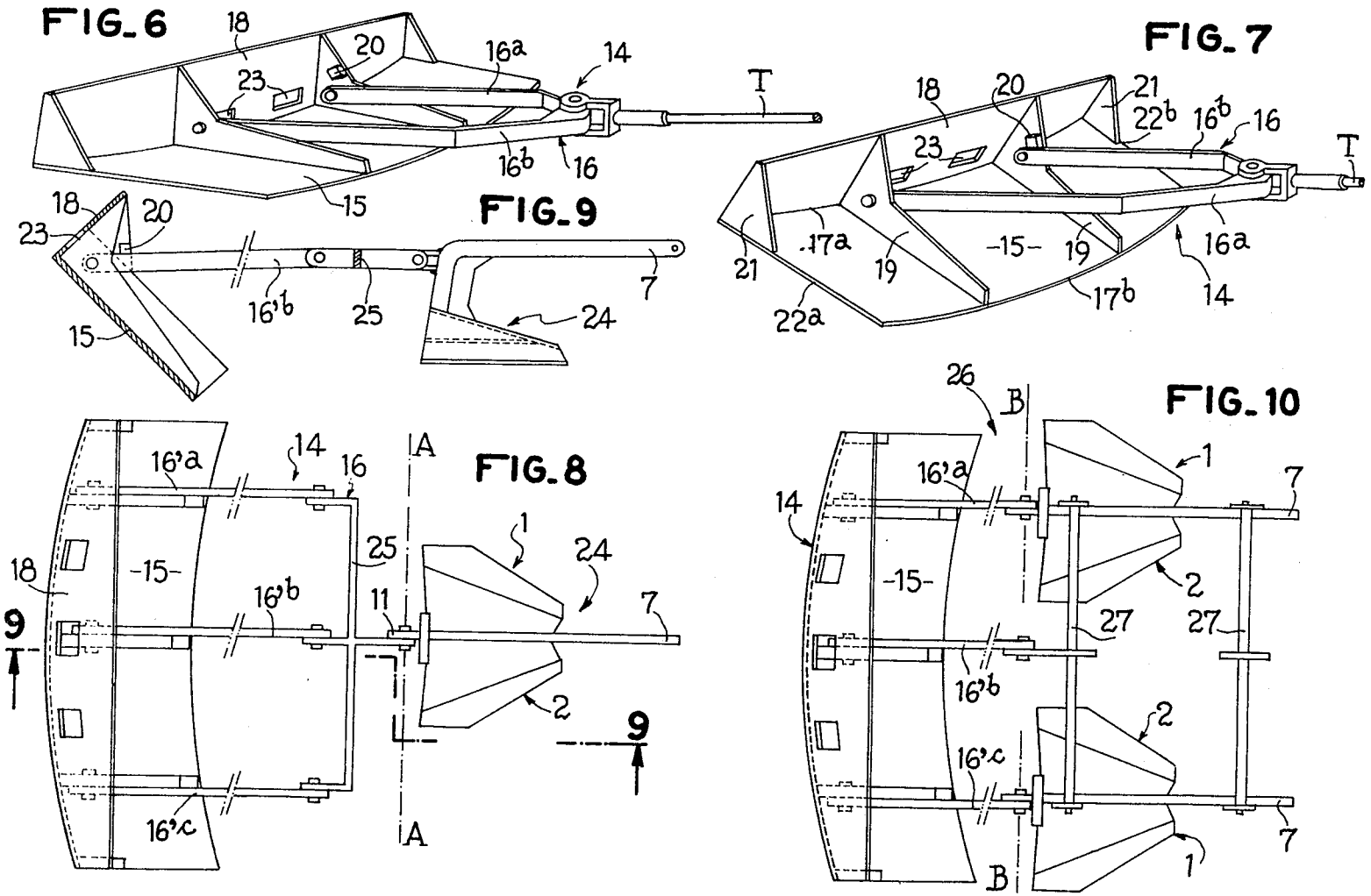
FIG. 6 is a perspective view of an anchor according to the invention having anchoring elements of the "sheet" type shown in the inoperative or storage position thereof.
FIG. 7 is a view similar to FIG. 6 showing the position that the "sheet" type anchoring element assumes when it is engaged in the ground and a pull is exerted on the anchor.
FIG. 8 is a top plan view of an anchoring system according to the invention comprising an anchor having a "sheet" type anchoring element and an anchor having a plough type element disposed in end-to-end relation.
FIG. 9 is a sectional view taken on line 9—9 of FIG. 8.
FIG. 10 is a view similar to FIG. 8 in which the anchoring system comprises two anchors having a plough type element and disposed in side-by-side relation.

With reference now to FIGS. 6 and 7 which show an anchor 14 having an anchoring element of the "sheet" type, this term being employed by analogy with retaining surfaces or anchoring plates which are currently employed in the mechanics of grounds. This anchor 14 therefore comprises the sheet element 15 and a coupling device 16 for connecting the element 15 to pulling means, this coupling device being constituted in the illustrated embodiment by two pivotally connected shanks $16^a$, $16^b$ which are interconnected at the free end thereof. The sheet element 15 is constituted by a plate in the shape of a portion of a cylinder whose concavity faces the shanks $16^a$, $16^b$ and which is curved in the direction of the span thereof so that any tangent to the part-cylindrical surface in a cross section of this surface is orthogonal to the shanks $16^a$, $16^b$ and consequently to the direction of the pull exerted on the anchor in service of the latter. The radius of curvature is so arranged as to provide a distribution of the pressures throughout the concave surface without marginal creep. By way of example, this radius may be substantially equal to the span of the element 15. In water, this shape increases the resistance to displacement owing to its high coefficient of drag Cx. The sheet element has a front edge $17^a$ and a ground-engaging rear edge $17^b$ which are disposed in cross sections of the part-cylindrical surface, or these edges, or one thereof, may have, when viewed in a direction perpendicular to the axis of the part-cylindrical surface, a V-shape which may be rounded or some other shape. A retaining plate 18, integral with the front edge $17^a$, extends from the latter on the concave of the sheet element. The connection between the anchoring plate 15 and the retaining plate 18 is completed by longitudinal reinforcing plates 19 to which the shanks $16^a$, $16^b$ are pivotally connected. Stops 20 limiting the maximum angle of opening of the shanks $16^a$, $16^b$ relative to the anchoring element 15 when the latter is in engagement and the anchor 14 is subjected to a pull. Reinforcements 21 constituted by triangular corners are provided between the retaining plate 18 and the anchoring plate 15 in the vicinity of the rectilinear lateral edges $22^a$, $22^b$ of the anchoring plate. Two openings are provided in the retaining plate 18 to allow the pasty ground or interstitial water to slightly run through when the anchor 14 is subjected to a pull so as to stabilize the surface by avoiding oscillations.

The anchor 14 is particularly well adapted for use in soft and very soft grounds since it acts in the mass of these beds by bearing against a large volume of ground, which affords a very good anchoring force in the ground in question. When the anchor is engaged and subjected to a pull as shown in FIG. 7, the retaining plate 18 has for function to prevent the anchor from sinking too far into the ground under the effect of the pull exerted on the shanks and laterally inclining relative to the surface of the ground.

It will be understood that many modifications may be made in this anchor. Thus three or more shanks may be provided instead of two. Moreover, in order to simplify the construction, the shanks may be fixed in position instead of being pivotally mounted. However, the pivotal mounting of the shanks has the advantage of reducing the overall size of the anchor in the storage position thereof shown in FIG. 6, and allowing the stacking of several identical anchors in this position. The shanks may be provided with means defining planar surfaces or small floats if it is desired that they resist an excessive sinking into soft mud or, on the contrary, the shanks may be profiled in such manner as to be capable of cleaving the ground in the case of harder muds. These floats may also be mounted on the anchoring element 15 or connected to the latter by a cable or other means for stopping the sinking thereof at the desired depth, for example in the case of grounds of the ultra clay type or any other excessively soft grounds. These floats may be constituted by any appropriate material and their upward thrust must solely balance the weight and the anchor sinking component so that merely the horizontal resistance component is employed in the anchoring proper. Note that the number and position of the openings 23 in the retaining plate 18 are not critical and if desired they may be eliminated or rendered partly or completely closable, for example by movable flaps. Further, the retaining plate 18, instead of extending from the concave side of the screen element 15, may extend in the opposite direction or extend on each side of the element 15. Moreover, if the retaining plate 18 is provided on the convex side of the element 15, it may be provided in a place other than the front edge $17^a$ and be possibly in the shape of an arc of a circle or have a V-shape for example. As in the case of the anchor 1 having a plough element, stabilizing deflector flaps may be provided.

Reference will now be made to FIG. 8 which shows a first embodiment of a modular anchoring system 24 comprising an anchor 1 of the type shown in FIGS. 1 to 5, and an anchor 14 of the type shown in FIGS. 6 to 7. In the embodiment shown in FIGS. 8 and 9, the anchor 14 having a "sheet" element comprises three shanks $16'^a$, $16'^b$, $16'^c$, which are pivotally connected at the ends thereof to a strong rigid member 25 to which the anchor 1 is pivotally connected, by the member 11 thereof, to pivot about a transverse pivot axis A—A which is adapted to impart to the system a transverse rigidity and allow a relative pivotal movement between the two anchors 1 and 14 in the longitudinal plane in which the pull is exerted in service of the anchoring system. Owing to this transverse rigidity and to the very high lateral stability of the anchor 14, the presence of a stock 12 on the anchor 1 is not essential here.

In service, the anchoring system 24 provides a very good efficiency irrespective of the type of ground encountered, the anchor 14 having a sheet element providing a very good anchoring force in the case of very soft ground and the anchor 1 having the plough element being preponderant in the case of a ground which is soft to very hard. However, the beds encountered must not be considered with respect to merely the surface thereof but also in depth and in this respect the most frequent case is that of a ground which is relatively soft on the surface and becomes increasingly hard as one moves away from this surface. From this point of view, the anchoring system according to the invention has been found to be even better adapted, since, while the anchor 14 having the screen element is maintained on the surface by the retaining plate 18 thereof and provides maximum efficiency in the generally very soft or soft ground it encounters, the anchor 1 having the plough element can, owing to the transverse pivotal connection thereof to the anchor 14 having the sheet element, sink deeply into the harder ground and also effectively contribute to giving the assembly a high anchoring power. For this purpose, the shanks $16'^a$, $16'^b$, $16'^c$ of the anchor 14 must be provided sufficiently long to allow a satisfactory sinking of the anchor 1.

With reference to FIG. 10 which shows a modification 26 of the anchoring system in which there are provided two anchors 1 of the plough type element which are rigidly coupled by two rods 27 fixed to their respective shanks, this pair of anchors 1 being pivotally connected to the shanks $16'^a$, $16'^c$ of the anchor 14 to pivot about a common transverse pivot axis B—B. Thus the two rigidly interconnected anchors 1 of the plough type can together pivot with respect to the anchor 14 and sink into the ground encountered. Compared with the embodiment shown in FIGS. 8 and 9, this second embodiment results in an improved performance in a ground which is soft to very hard in depth. It will be understood that the anchoring power could be still further increased by providing one or more other pairs of anchors 1 having a plough element rigidly coupled together, the anchors of one pair being pivotally connected by the member 11 thereof to the ends of the shanks provided with an aperture $7^c$ of the anchors of the preceding pair so that all the pivot axes are parallel to each other. Two anchors 14 having a sheet element could also be arranged one behind the other and pivotally connected to each other to pivot about a transverse pivot axis parallel to the axis A—A or B—B. Generally, one or more anchors 14 having a sheet element may be combined with one or more anchors 1 having a plough element so as to impart to the anchoring system the maximum efficiency in accordance with the type of ground encountered on the surface and in depth, whereas conventional anchors of the reversible type merely provide a more or less satisfactory compromise in varied grounds without being capable of reaching maximum efficiency in the case of grounds which are very hard and very soft. In certain ground conditions, it may even be preferable to combine only anchors 14 having a sheet element or anchors 1 having a plough element.

It must be understood that the anchoring system according to the invention is not limited to the combination of anchors of the two embodiments described hereinbefore but enbraces any anchoring system formed from at least two anchors of different types, one having an anchoring element of the sheet type which has a very good efficiency in soft and very soft ground, and the other having an anchoring element of the plough type which has an excellent efficiency in soft to very hard ground.

One of the advantages of the anchoring system according to the invention is that its total power is proportional to the sum of the unit powers of the different anchors constituting the system, owing to the fact that the coupling means between the anchors transmit without elastic delay all the pulling forces exerted and thus distribute the forces throughout the anchoring points, whereas this is not so with conventional techniques of coupling and backing. Moreover, the association within the system of a plurality of identical anchors is found to be more advantageous, for a given weight, than the use of a single anchor of the same type, from the point of view of both anchoring force and storage and transport. This is particularly true when, as is the case of the anchors 1 and 14 described hereinbefore, the two types of anchor from which the system is formed are capable of being fitted together. Indeed, owing to their storage within a small volume, it is possible to carry a sufficient number thereof on an auxiliary vessel and assemble them as required on the site of use in accordance with the geotechnical situation which is, for example, detected by the taking of samples. The presence of the "sheet" element imparts high transverse stability to the system which facilitates the laying of the system on the bed in as much as it is possible to allow, in the course of immersion, large deviations between the axis of the system and the subsequent direction of pull without the system overturning.

Having now described my invention what I claim as new and desire to secure by Letters Patent is:

1. An anchor for positioning on water floating machines, such as drilling platforms, drags, landing stages, river crossing structures, said anchor being intended to be lowered to a position flat on the water bed and comprising a plough and a shank which is rigid with the plough, the plough having substantially a dihedral shape and comprising lateral substantially planar side walls defining therebetween an upper corner edge defined by the dihedral angle and having longitudinal edges which are substantially contained in a common plane perpendicular to a bisecting plane of the dihedral angle, the corner edge being downwardly inclined toward said common plane from an end of the corner edge in the vicinity of which end the shank is rigidly fixed to the plough, the anchor having a substantially constant wall thickness in the plough part thereof.

2. An anchor as claimed in claim 1, comprising wings which prolong said lateral sides and extend substantially in said common plane.

3. An anchor as claimed in claim 2, wherein the lateral sides and the wings of the plough are constituted by two folded sheets which are welded together along said corner edge.

4. An anchor as claimed in claim 1, wherein said plough has a truncated end defining two inclined surfaces for penetrating the ground, said inclined surfaces being inclined with respect to said common plane in the same direction as said corner edge.

5. An anchor as claimed in claim 1, wherein the lateral sides make therebetween an angle of substantially 90°–130°.

6. An anchor as claimed in claim 1, wherein the lateral sides make therebetween an angle of substantially 110°.

7. An anchor as claimed in claim 1, wherein said corner edge is inclined with respect to said common plane at an angle of substantially 10°–45°.

8. An anchor as claimed in claim 1, comprising a stiffening plate which extends between said lateral sides in a direction substantially parallel to said common plane.

9. An anchor as claimed in claim 1, wherein the shank is inclined from the free end thereof at an angle of substantially 5° with respect to said common plane.

10. An anchor as claimed in claim 1, comprising a crook which connects the shank to the plough, and a hooking member integral with the crook and extending in a direction opposed to a direction in which the shank extends from the crook.

11. An anchor as claimed in claim 1, comprising a detachable bar constituting a stock which extends transversely of said bisecting plane, a tube fixed to the anchor adjacent said end of said corner edge for receiving said bar, and detachable fixing means for fixing said bar in said tube.

12. An anchor comprising an anchoring element of the "sheet" type and a coupling device for connecting said sheet element to pulling means, said sheet element having a substantially part-cylindrical surface and defining an upper edge and a lower edge which constitutes a ground engaging edge in anchor operation and having a concavity which faces upwardly in anchor operation toward said coupling device, said coupling device being connected to a part of said sheet element adjacent said upper edge and extending in a given general direction rearwardly from said sheet element in a plane of symmetry of said coupling device, said part-cylindrical surface having an axis which is contained in said plane and makes an acute angle with said given general direction, said upper edge and said lower edge being contained in planes which are perpendicular to said axis of said part-cylindrical surface, and a retaining plate integral with said anchoring element and extending upwardly from the front upper edge of said anchoring element on at least one side thereof.

13. An anchor as claimed in claim 12, wherein said coupling device is connected to the sheet element to pivot about an axis perpendicular to said plane of symmetry from a position corresponding to said acute angle to a position corresponding to an angle smaller than said acute angle.

14. An anchor as claimed in claim 12, comprising reinforcing plates integral with said anchoring element and said retaining plate, said coupling device comprising at least two shanks connected to said reinforcing plates to pivot about an axis perpendicular to said plane of symmetry from a position corresponding to said acute angle to a position corresponding to an angle smaller than said acute angle.

15. An anchor as claimed in claim 12, wherein said retaining plate is provided with at least one throughway opening.

16. An anchor system as claimed in claim 15, comprising at least two anchors each having an anchoring element of the "sheet" type, and means for pivotally interconnecting said two anchors so that said two anchors are relatively pivotable about an axis parallel to said transverse pivot axis.

17. A modular anchoring system adaptable to different varieties of grounds as concerns the surface and thickness of the grounds, said system comprising at least a pair of anchors located in a longitudinal plane and each having an anchoring element of the plough type for connection to pulling means and disposed in side-by-side relation to each other transversely of said longitudinal plane, means for rigidly interconnecting said pair of anchors, and at least a third anchor having an anchoring element of the "sheet" type and located in said longitudinal plane on a side of said pair of anchors opposed to said pulling means, means for pivotally interconnecting said pair of anchors and said third anchor so that said anchors are pivotable about an axis parallel to or coincident with a transverse pivot axis extending transversely of said longitudinal plane, whereby said system has a transverse rigidity and allows a relative pivotal movement between said anchors in said longitudinal plane substantially in which plane the pull is exerted by said pulling means in service of the system.

18. An anchor system as claimed in claim 17, further comprising at least a second pair of anchors each having an anchor element of the plough type and disposed in side-by-side relation, means for rigidly interconnecting said second pair of anchors, and means for pivotally connecting said first pair of anchors to, said second pair of anchors so that the pairs of anchors are relatively pivotable about an axis parallel to said transverse pivot axis.

19. A modular anchoring system adaptable to different varieties of grounds as concerns the surface and thickness of the grounds, comprising at least a first anchor located in a longitudinal plane and for connection to pulling means and at least a second anchor having an anchoring element of the "sheet" type and located in said longitudinal plane on a side of said first anchor opposed to said pulling means, means for pivotally interconnecting said first and second anchors so that the anchors are pivotable about a transverse pivot axis extending transversely of said longitudinal plane whereby said system has a transverse rigidity and allows a relative pivotal movement between said anchors in said longitudinal plane substantially in which plane the pull is exerted by said pulling means in service of the system, said first anchor comprising a plough and a shank, the plough having substantially a dihedral shape and comprising lateral substantially planar side walls defining therebetween an upper corner edge defined by the dihedral angle and having longitudinal edges which are substantially contained in a common plane perpendicular to a bisecting plane of the dihedral angle, the corner edge being downwardly inclined toward said common plane from an end of the corner edge in the vicinity of which end the shank is rigidly fixed to the plough, the anchor having a substantially constant wall thickness in the plough part thereof, the shank being the part of said first anchor which is for connection to said pulling means.

20. A modular anchoring system adaptable to different varieties of grounds as concerns the surface and thickness of the grounds, comprising at least a first anchor located in a longitunal plane and for connection to pulling means and at least a second anchor having an anchoring element of the "sheet" type and located in said longitudinal plane on a side of said first anchor opposed to said pulling means, means for pivotally interconnecting said first and second anchors so that the anchors are pivotable about a transverse pivot axis extending transversely of said longitudinal plane whereby said system has a transverse rigidity and allows a relative pivotal movement between said anchors in said longitudinal plane substantially in which plane the pull is exerted by said pulling means in service of the system, said first anchor comprising a plough and a shank, the plough having substantially a dihedral shape and comprising lateral substantially planar side walls defining therebetween an upper corner edge defined by the dihedral angle and having longitudinal edges which are substantially contained in a common plane perpendicular to a bisecting plane of the dihedral angle, the corner edge being downwardly inclined toward said common plane from an end of the corner edge in the vicinity of which end the shank is rigidly fixed to the plough, the anchor having a substantially constant wall thickness in the plough part thereof, the shank being the part of said first anchor which is for connection to said pulling means, said second anchor comprising an anchoring element of the "sheet" type and a coupling device for connecting said sheet element to said means for pivotally interconnecting said first and second anchors, the sheet element having a substantially part-cylindrical surface and defining an upper edge and a lower edge which constitutes a ground engaging edge in anchor operation and having a concavity which faces upwardly in anchor operation toward said coupling device, the coupling means being connected to a part of the sheet element adjacent said upper edge and extending in a given general direction rearwardly from the sheet element in a plane of symmetry of the coupling means and the part-cylindrical surface having an axis which is contained in said plane of symmetry and makes an acute angle with said given general direction, said plane of symmetry coinciding with said longitudinal plane.

21. An anchor for positioning on water floating machines, such as drilling platforms, drags, landing stages, river crossing structures, said anchor being intended to be lowered to a position flat on the water bed and comprising a plough and a shank which is rigid with the plough, the plough having a dihedral shape and comprising lateral planar side walls defining therebetween an upper corner edge defined by the dihedral angle and having longitudinal edges which are contained in a common plane perpendicular to a bisecting plane of the dihedral angle, the corner edge being downwardly inclined toward said common plane from an end of the corner edge in the vicinity of which end the shank is rigidly fixed to the plough, the anchor having a substantially constant wall thickness in the plough part thereof and comprising two wings which are contained in said common plane and respectively extend said lateral side walls on said longitudinal edges, said plough having an end remote from said end of the corner edge in the vicinity of which said end the shank is rigidly fixed to the plough which is truncated and defines two inclined surfaces for penetrating the ground, said inclined surfaces being inclined with respect to said common plane in the same direction as said corner edge.

* * * * *